US007892158B2

(12) United States Patent
Varga

(10) Patent No.: US 7,892,158 B2
(45) Date of Patent: Feb. 22, 2011

(54) PUSHUP APPARATUS

(76) Inventor: Thomas A. Varga, 1043 Ashwood La., Medina, OH (US) 44256

( * ) Notice: Subject to any disclaimer, the term of this patent is extended or adjusted under 35 U.S.C. 154(b) by 0 days.

(21) Appl. No.: 12/317,609

(22) Filed: Dec. 26, 2008

(65) Prior Publication Data

US 2009/0170676 A1 Jul. 2, 2009

Related U.S. Application Data

(60) Provisional application No. 61/008,846, filed on Dec. 26, 2007.

(51) Int. Cl.
*A63B 71/00* (2006.01)

(52) U.S. Cl. ..... 482/141

(58) Field of Classification Search ..... 482/14–17, 482/38, 126, 141, 129, 109, 131, 132, 44–46; 446/489; 211/88.04, 105.1, 123, 105.2, 105.3, 211/182; 248/165, 214, 298.1
See application file for complete search history.

(56) References Cited

U.S. PATENT DOCUMENTS

| | | | | | |
|---|---|---|---|---|---|
| 956,264 | A * | 4/1910 | Bailey | 482/97 |
| 2,562,095 | A * | 7/1951 | Hengst | 242/401 |
| 2,603,272 | A * | 7/1952 | Rowand | 5/130 |
| 3,637,205 | A * | 1/1972 | Bankston | 482/114 |
| 3,938,803 | A * | 2/1976 | Wilmoth et al. | 482/132 |
| 3,971,255 | A * | 7/1976 | Varney et al. | 482/114 |
| 4,111,417 | A * | 9/1978 | Gardner | 482/128 |
| 5,152,731 | A * | 10/1992 | Troutman | 482/106 |
| 5,290,209 | A * | 3/1994 | Wilkinson | 482/38 |
| 5,328,427 | A * | 7/1994 | Sleamaker | 482/71 |
| 5,873,311 | A * | 2/1999 | Schlattl | 108/44 |
| 6,068,535 | A * | 5/2000 | Hoyt | 446/227 |
| 6,186,930 | B1 * | 2/2001 | Ignaczak | 482/141 |
| 6,932,750 | B1 * | 8/2005 | Dorner | 482/142 |
| 7,086,999 | B2 * | 8/2006 | Jeneve et al. | 482/106 |
| 7,294,100 | B2 * | 11/2007 | Bull | 482/51 |
| 2008/0070764 | A1 * | 3/2008 | Amzallag et al. | 482/129 |

* cited by examiner

*Primary Examiner*—Loan Thanh
*Assistant Examiner*—Allana Lewin
(74) *Attorney, Agent, or Firm*—Woodard, Emhardt, Moriarty, McNett & Henry, LLP

(57) ABSTRACT

A pushup apparatus having a centered T-Tube, right and left Slide Tube, a medial and lateral Stop Ring located on each Slide Tube. The T-Tube will contain a hole/knotch on both the right and left side that will receive the Locking Pin Assembly from the corresponding right and left Slide Tube. The T-Tube and Slide Tubes will insert into a Foot and the Foot will be finished with a Foot Grip. The right side Slide Tube has a Handle, Handle Cap, Handle Grip assembly that moves freely and independent along the linear path of the right side Slide Tube between its respective medial and lateral Stop Rings. The left side Slide Tube has a Handle, Handle Cap, Handle Grip assembly that moves freely and independent along the linear path of the left side Slide Tube between its respective medial and lateral Stop Rings. The free independent motion will be achieved by use of Linear Bearing Assemblies. The Linear Bearing Assembly is affixed within the Handle, Handle Cap, Handle Grip assembly. The free and independent movement forces the user to create the symmetry during the movement of the exercise, thus engaging the stabilizer muscles of the bodies trunk. The right and left Slide Tube will have a Locking Pin Assembly at their medial ends that will connect to holes/knotches in the T-Tube.

18 Claims, 13 Drawing Sheets

PUSHUP APPARATUS (This application claims the benefit of U.S. Provisional Application No. 61/008,846 filed Dec. 26, 2007)

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of physical fitness/More particularly, the present invention is in the technical field of the pushup exercise/More particularly, the present invention is in the technical field of pushup apparatus.

There are several types of existing pushup apparatus known in the prior art. However, to the best of the inventor's knowledge, there is no pushup apparatus that combines an independent sliding/converging motion with the use of linear bearings and a segmented bar that has the ability of the hand grips to spin freely around the axis of its stationary bar allowing for forearm development as well as the benefits of a converging pushup exercise.

Fwu, in U.S. Pat. No. D354,100 and Kinkel, in U.S. Pat. No. 5,928,119 makes use of an exercise apparatus that is in a fixed static position once the user performs the exercise. The disadvantage is the user does not complete the proper biomechanics during the range of motion of the exercise. There is no convergence toward midline of the body during the exercise.

Jeneve, in U.S. Pat. No. 7,086,999 discloses an apparatus that makes use of a straight bar with cables and pulleys that has handles that remain equidistant from the center. The disadvantage of the Jeneve apparatus is that the sliding hand grips are dependent upon each other. The hand grips remain equidistant from the midline as they move through the range of motion. An independent motion is needed to achieve the maximum core stability training involved during the pushup exercise.

Ignaczal, in U.S. Pat. No. 6,186,930 discloses an apparatus that has the capability to move midline to the user's body axis. It is comprised of a base that has numerous notches to lock out the hand grips for a static hand position. The disadvantage is that the sliding members are designed to be locked in various positions to create a static/non lateral movement during the exercise. If the apparatus is unlocked, it will create excessive drag during the exercise do to the user's body weight being forced down vertically pressing the members against the base.

BRIEF SUMMARY OF THE INVENTION

The present invention is a pushup apparatus used to strengthen the upper body. With the user in the prone position horizontal to the floor, the user raises the upper body up off of the ground by pushing upward and inward against the grips with their hands. The trunk of the body remains straight throughout the exercise and feet/toes remain on the ground. The grips move free and independent of each other along the elongated bar. The elongated bar defines the path of motion of the handgrips. This free and independent motion allows the user to perform a converging pushup while increasing the use of the stabilizing core/trunk muscles of the user. The converging motion toward the midline allows for the chest muscles to increase/maximize the range of motion over the traditional pushup exercise done without the apparatus.

DETAILED DESCRIPTION OF THE INVENTION

Figure 5:
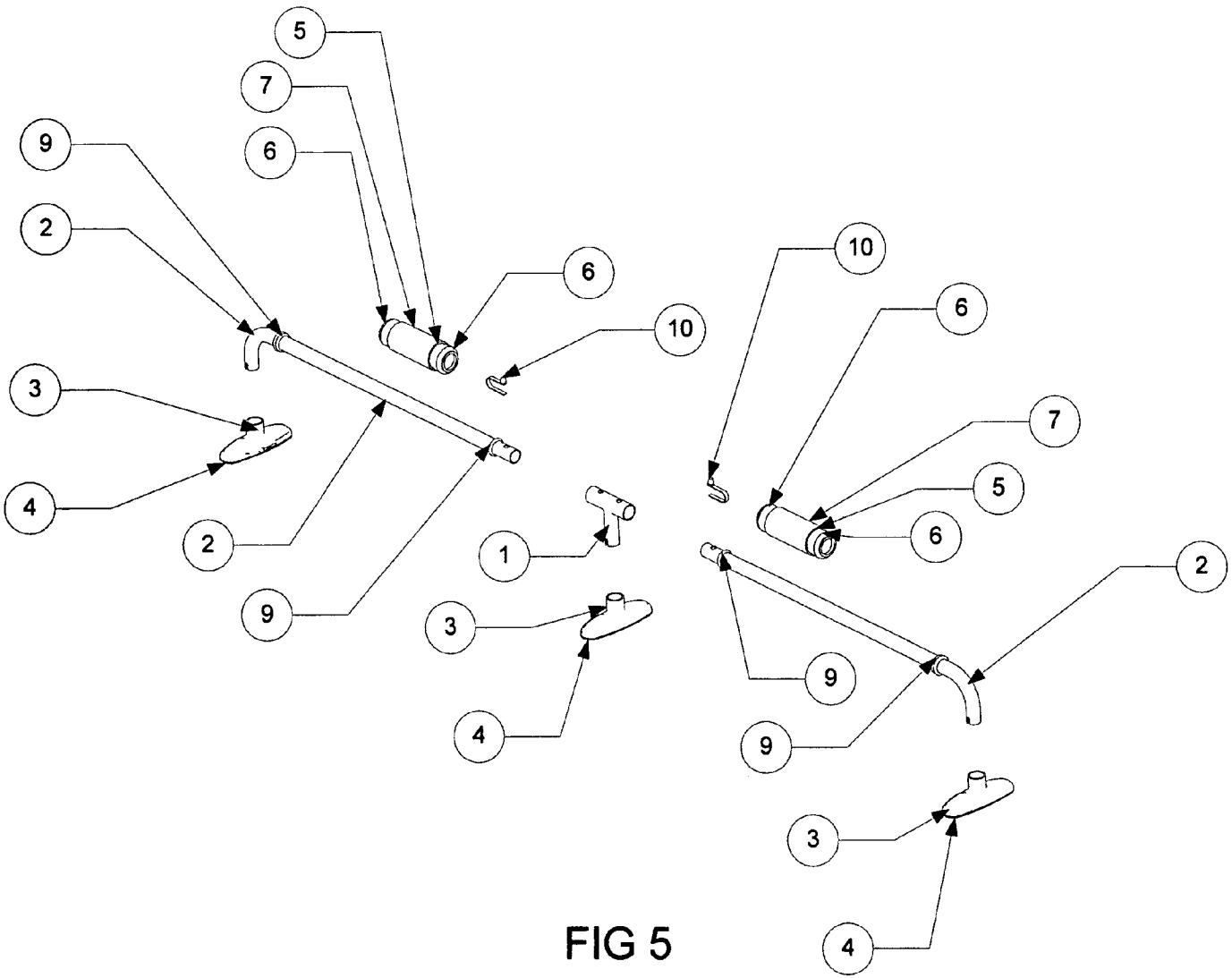
FIG. 5 is a front off center view of the present invention with the right and left side Slide Tube (2) separated from the T-Tube (1) The right and left side Locking Pin Assembly (10), Handle (5), Handle Cap (6), Handle Grip (7), Foot (3) and Foot Grip (4) are removed from Slide Tube (2). The T-Tube (1) is separated from both the right and left side Slide Tube (2) and center Foot (3) and Foot Grip (4).
Figure 6:
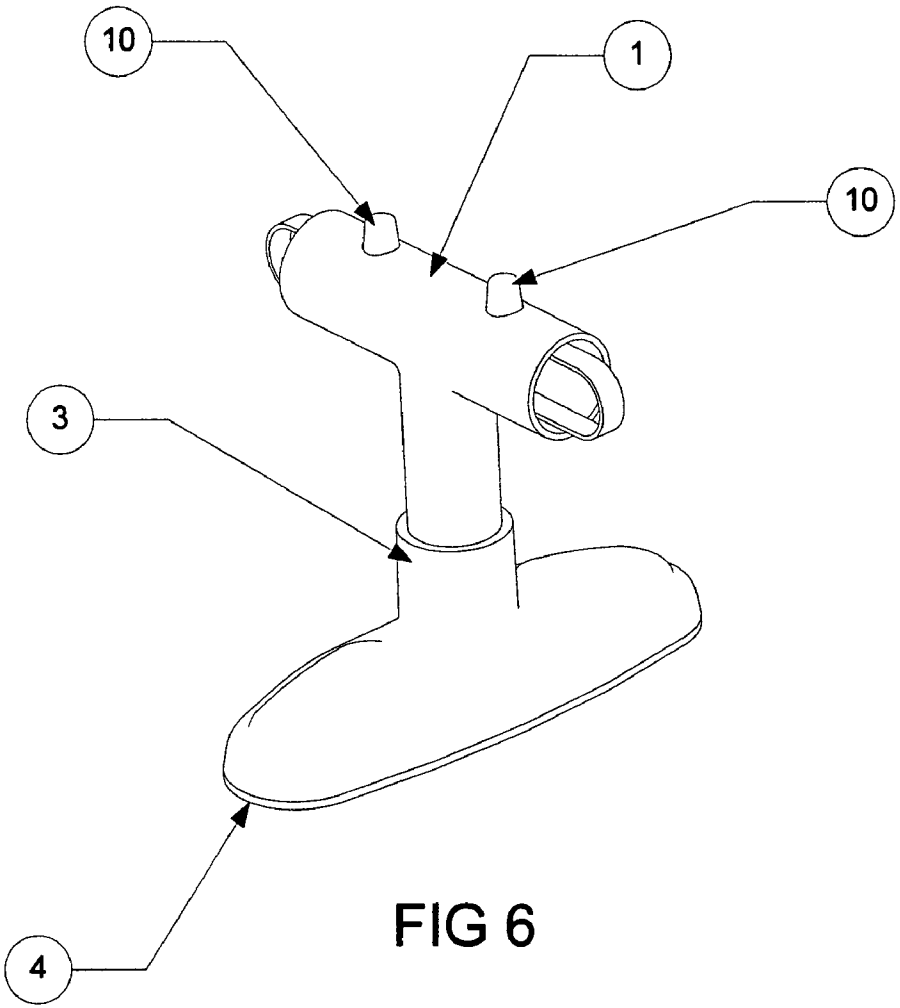
FIG. 6 is a front off center view of the present invention's T-Tube (1), Locking Pin Assembly (10), Foot (3), Foot Grip (4) it its assembled state.
Figure 7:
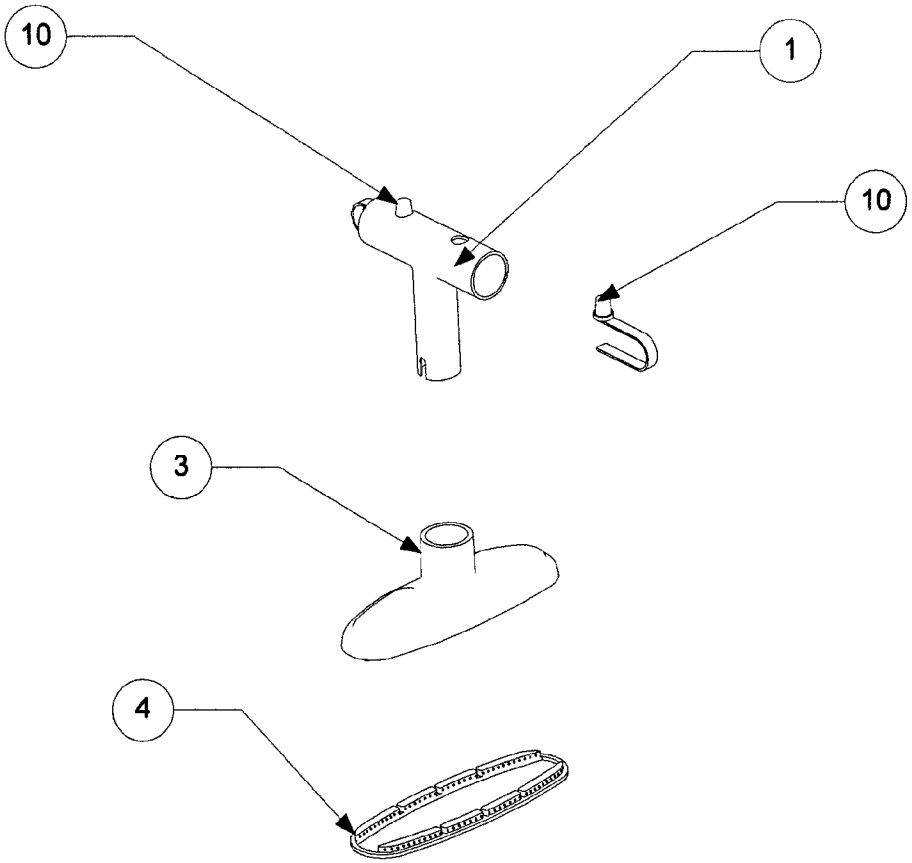
FIG. 7 is a front off center view of the present invention's T-Tube (1), right side Locking Pin Assembly (10), Foot (3), Foot Grip (4) in its unassembled state.
Figure 8:
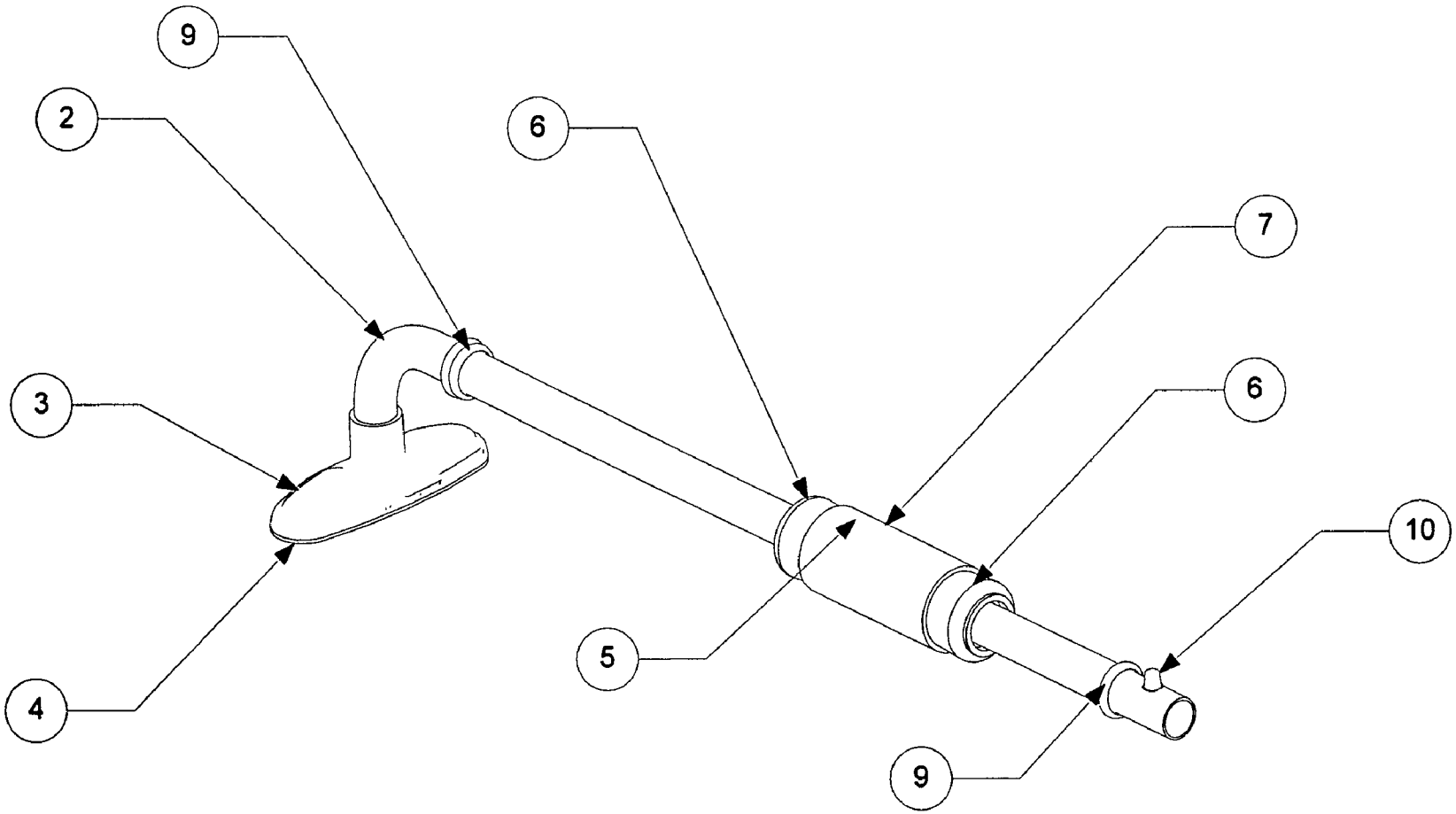
FIG. 8 is a front off center view of the present invention's left side Slide Tube (2), left side center and lateral Stop Ring (9), Handle (5), Handle Cap (6), Handle Grip (7), Foot (3), Foot Grip (4), right side Locking Pin Assembly (10), in its assembled state.
Figure 9:
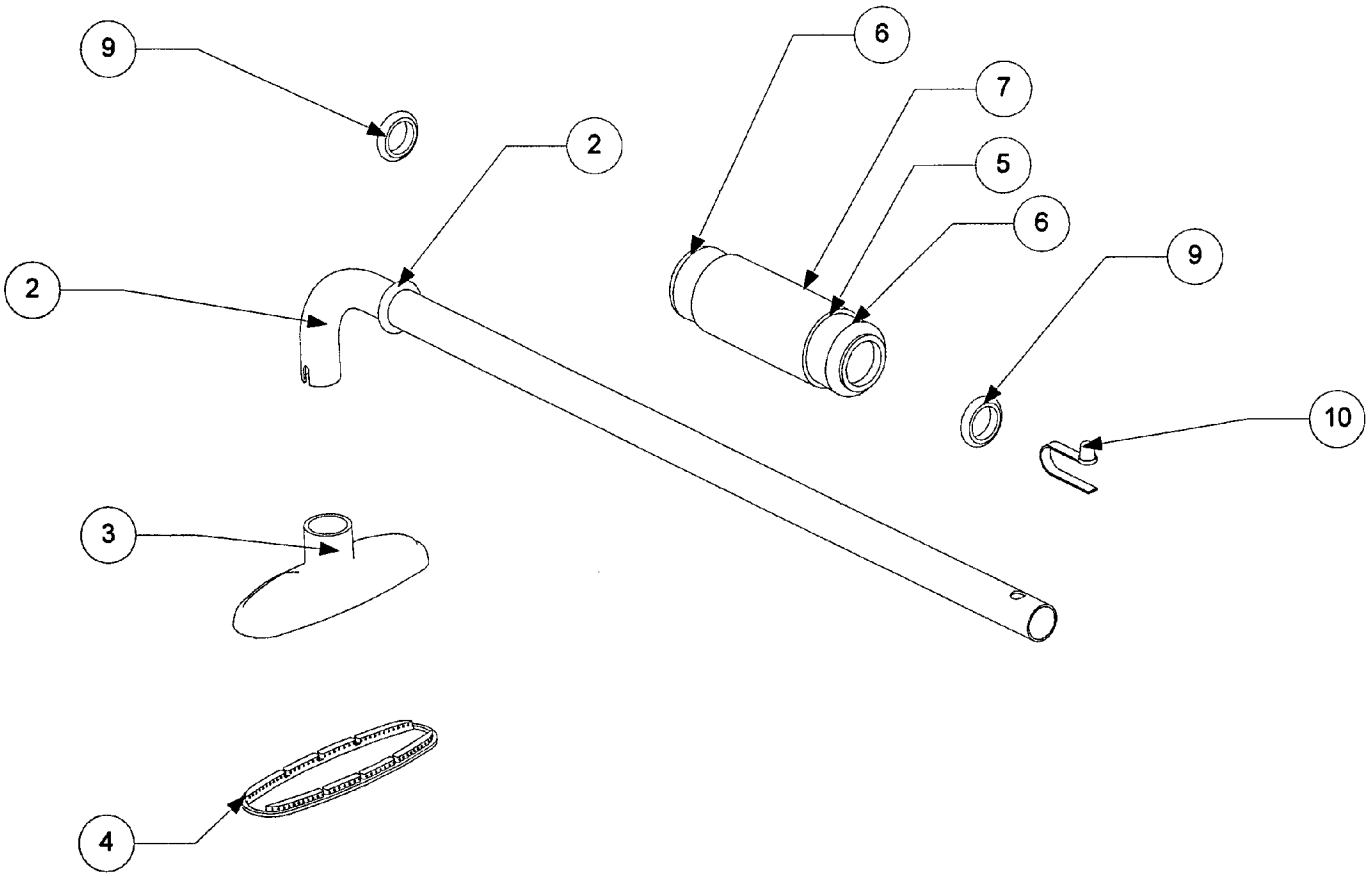
FIG. 9 is a front off center view of the present invention's left side Slide Tube (2), left side center and lateral Stop Ring (9), Handle (5), Handle Cap (6), Handle Grip (7), Foot (3), Foot Grip (4), right side Locking Pin Assembly (10), in its unassembled state.
Figure 10:
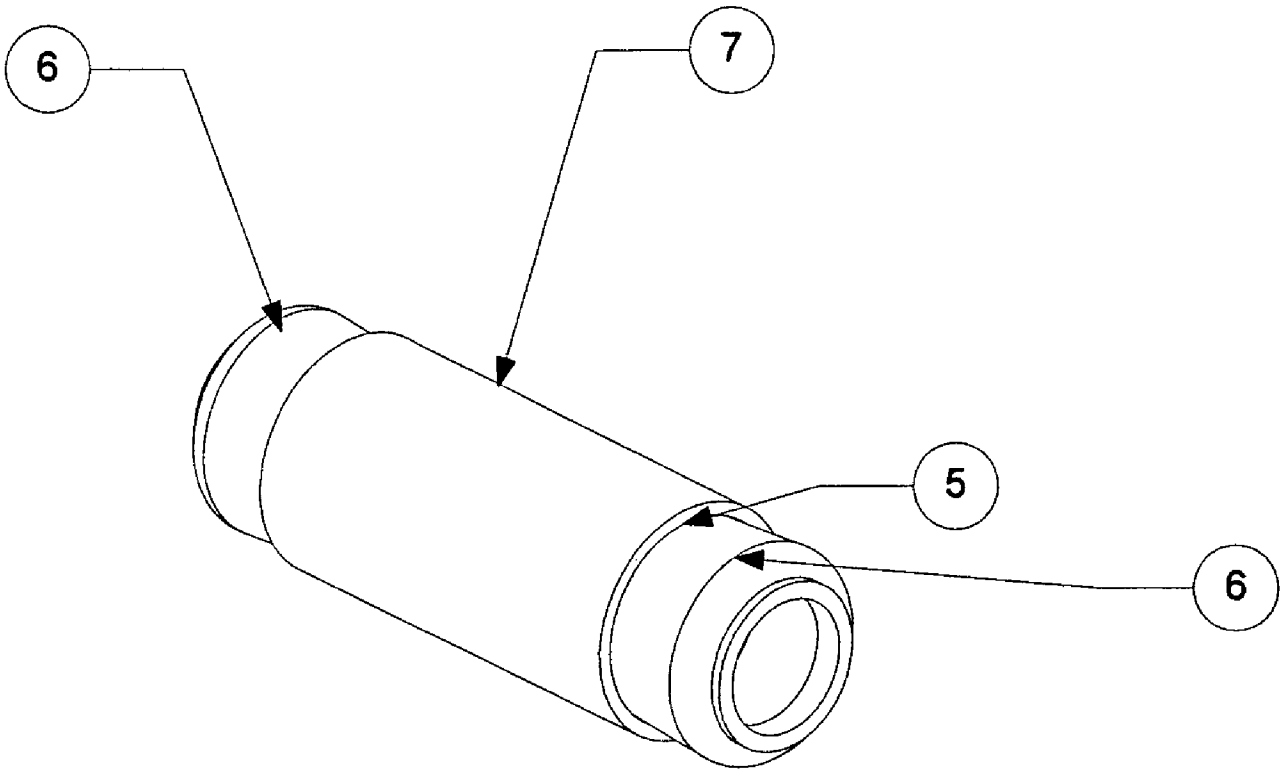
FIG. 10 is a front off center view of the present invention's Handle (5), Handle Cap (6), Handle Grip (7) in its assembled state.

Referring now to the invention in more detail, in (FIGS. 1A & 1B), there is shown a front view of the assembled pushup apparatus, having a center T-Tube (1) and a right and left side Slide Tube (2). The right and left side Slide Tube will each contain a medial and lateral Stop Ring (9). The T-Tube (1) will have a hole/knotch on both the right and left side that will receive a Locking Pin Assembly (10) from both the right and left Slide Tube (2) when connected (FIG. 5). The T-Tube and right and left side Slide Tube (2) insert into a Foot (3). The Foot (3) is finished with a Foot Grip (4). The right side Slide Tube (2) has a Handle (5), Handle Cap (6), and Handle Grip (7) assembly (FIG. 10) that moves freely and independent along the linear path of the right side Slide Tube (2) between its respective medial and lateral Stop Rings (9). The left side Slide Tube (2) has a Handle (5), Handle Cap (6), and Handle Grip (7) assembly (FIG. 10) that moves freely and independent along the linear path of the left side Slide Tube (2) between its respective medial and lateral Stop Rings (9).

Figure 11:
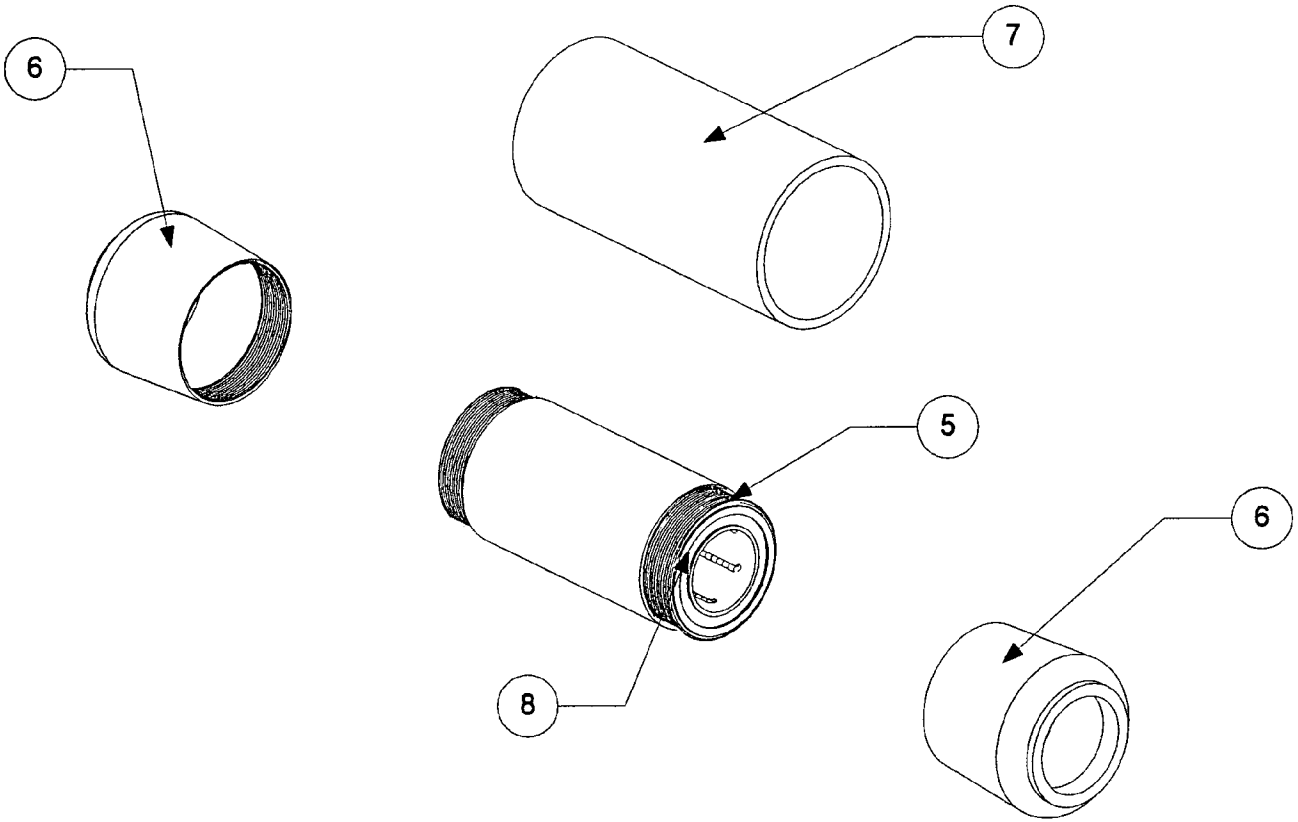
FIG. 11 is a front off center view of the present invention's Handle (5), Handle Cap (6), Handle Grip (7), in its unassembled state. The Linear Bearing Assembly (8) is shown affixed within and surrounded by the Handle (5).
Figure 12:
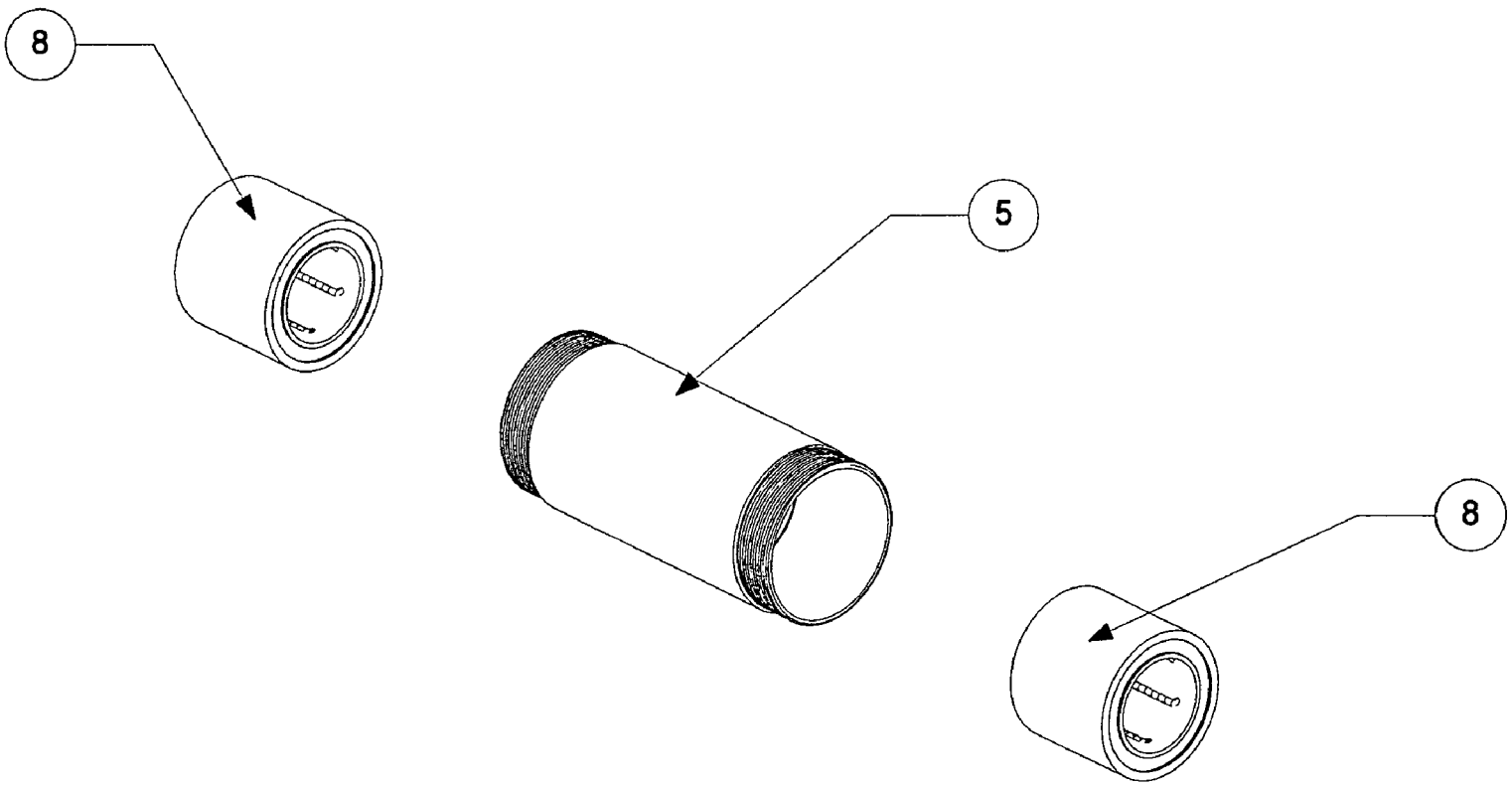
FIG. 12 is a front off center view of the present invention's Handle (5), and Linear Bearing Assembly (8) in its unassembled state.

In further detail, still referring to the invention of (FIGS. 1A & 1B), the right and left Handle (5), Handle Cap (6), Handle Grip (7) assembly (FIG. 10) will have enough free independent motion between its medial and lateral Stop Ring (9) so as to accommodate a wide range of user sizes/heights. The free independent motion will be achieved by use of the Linear Bearing Assembly (8) shown in (FIG. 12). The Linear Bearing Assembly (8) will be affixed within and surrounded by the Handle (5), Handle Cap (6), Handle Grip (7) assembly (FIG. 11). There will be quantity 2 Linear Bearing Assemblies (8) within each Handle (5), Handle Cap (6), Handle Grip (7) assembly. The Linear Bearing Assembly (8) allows for the free independent motion over the Slide Tube (2).

Figure 1A:
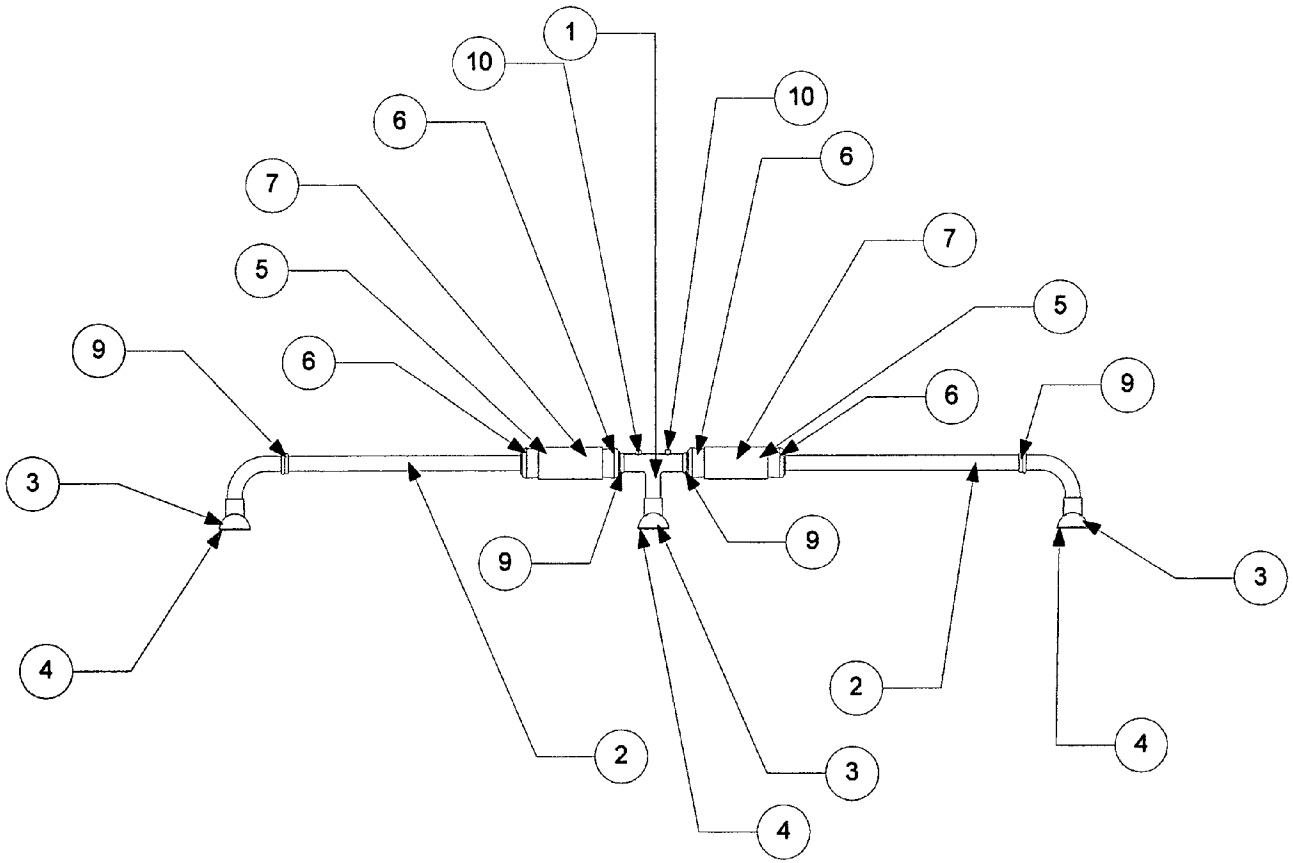
FIG. 1A is a front view of the present invention in its assembled state with the Handle Grips (7) next to the center Stop Rings (9). Toward midline
Figure 1B:
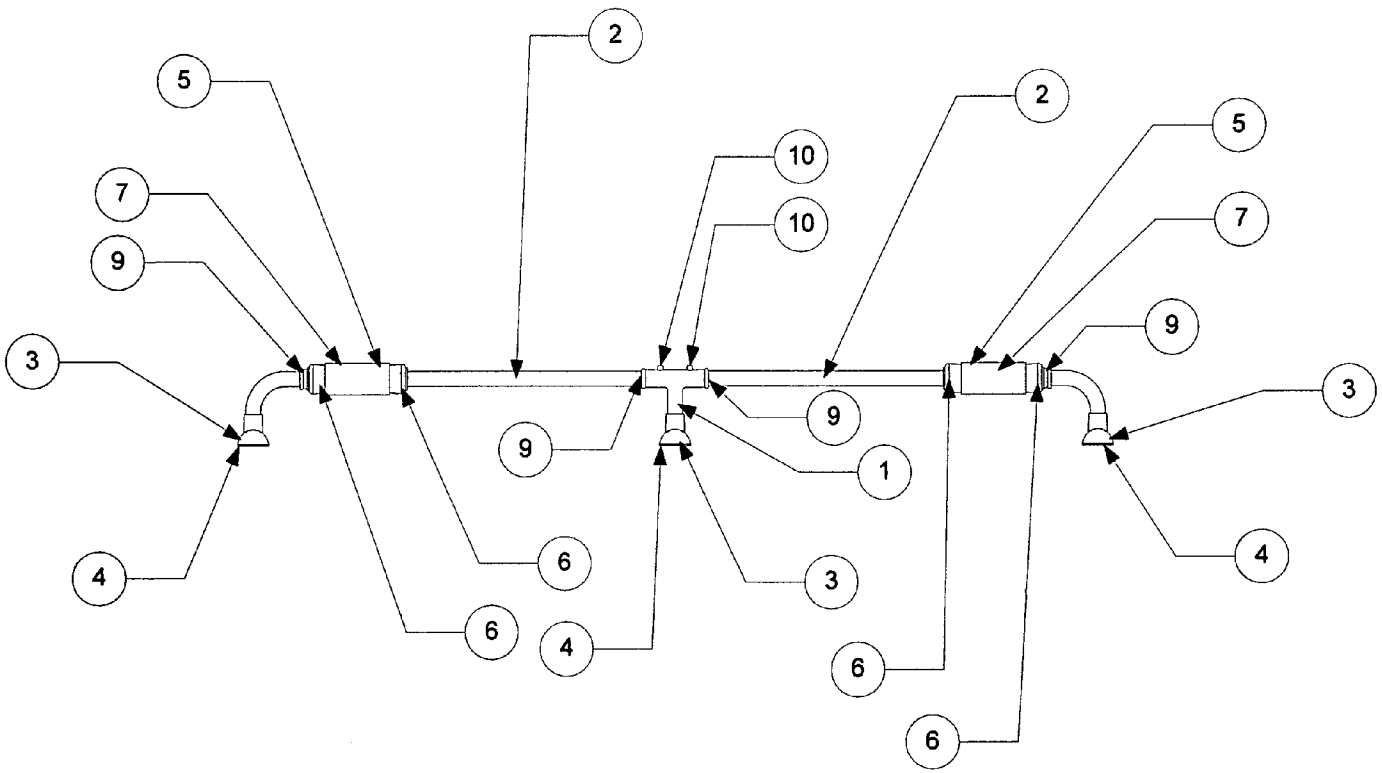
FIG. 1B is a front view of the present invention in its assembled state with the Handle Grips (7) away form the center Stop Rings (9).) Away from midline
Figure 2:
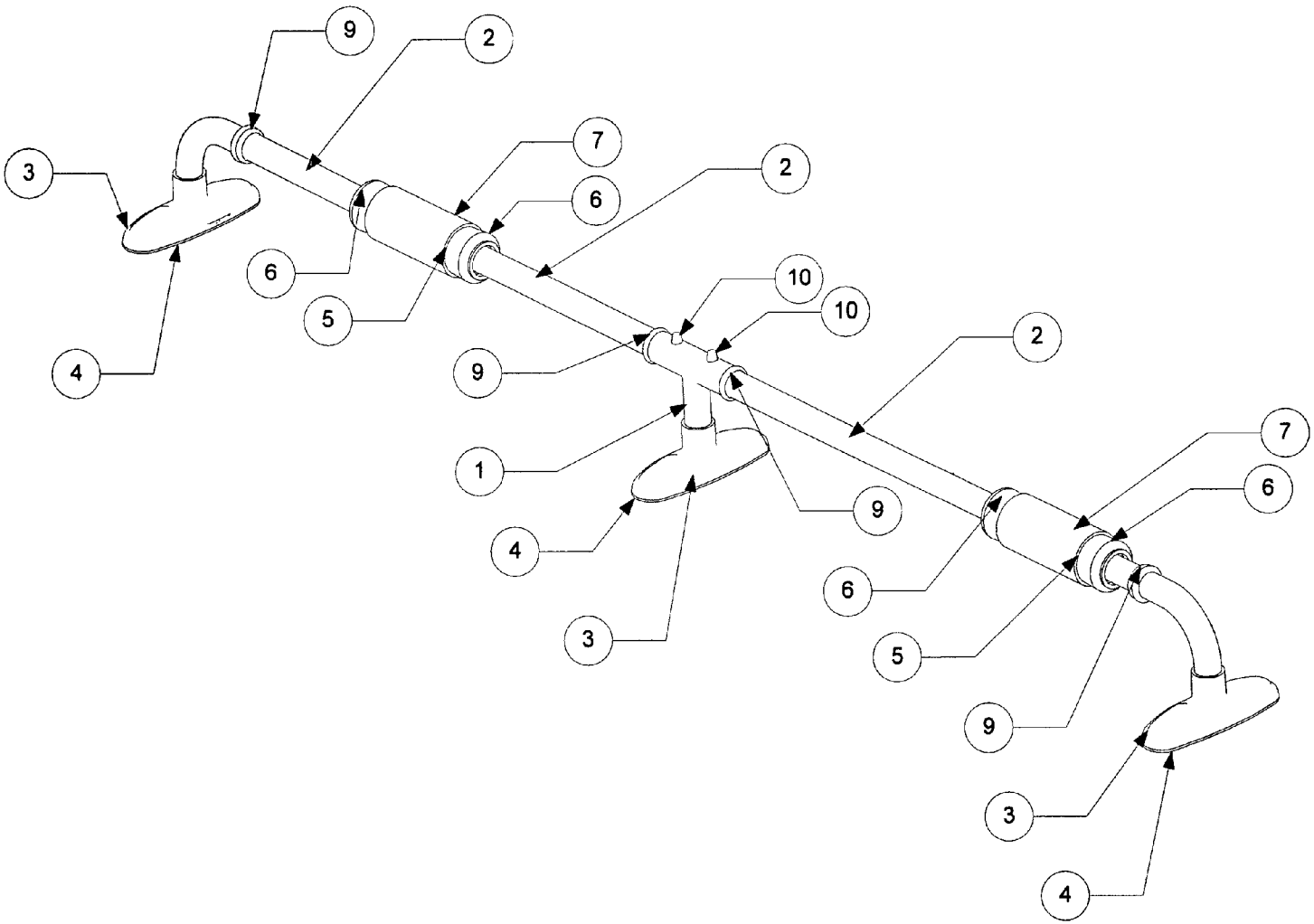
FIG. 2 is a front off center view of the present invention it its assembled state.
Figure 3:
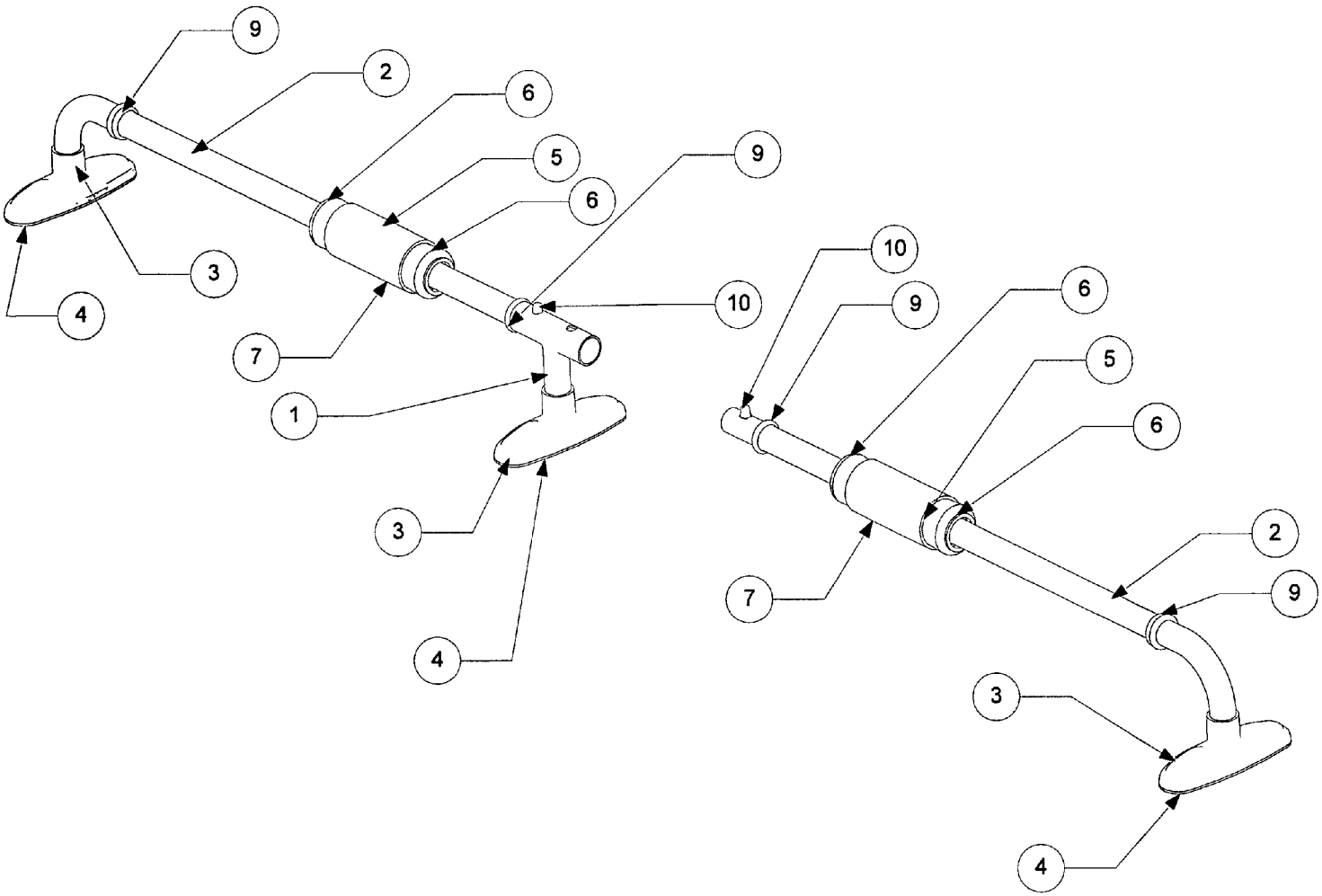
FIG. 3 is a front off center view of the present invention with the right side slide tube (2) separated from the T-Tube (1).

FIG. 1B is reflective of the pushup apparatus in the starting position view of the pushup exercise with the user in the prone/down position. The user grasps the right Handle (5), Handle Cap (6), Handle Grip (7) assembly with the right hand, and grasps the left Handle (5), Handle Cap (6) Handle Grip (7) with the left hand. With both the right and left side Handle (5), Handle Cap (6), Handle Grip assembly now in the lateral starting position in (FIG. 1B). The user pushes down and inward toward the medial Stop Rings (9) thus raising the body into the up position of the pushup exercise with the pushup apparatus in position of (FIG. 1A). The right Handle (5), Handle Cap (6), Handle Grip (7) assembly will be toward the T-Tube (1) and resting against the right medial Stop Ring (9). The left Handle (5), Handle Cap (6), Handle Grip (7) assembly will be toward the T-Tube (1) and resting against the left medial Stop Ring (9). While maintaining the grasp with the right and left hand, the user then reverses the motion back to the down and lateral position by lowering their body weight back to prone, and moving the right Handle (5), Handle Cap (6), Handle Grip (7) assembly back to the right lateral Stop Ring (9) and the left Handle (5), Handle Cap (6), Handle Grip (7) assembly back to the left lateral Stop Ring (9) (FIG. 1B). The user should remain centered with their chest over the T-Tube (1) during the performance of the exercise. The free and independent movement forces the user to create the symmetry during the movement of the exercise.

Figure 4:
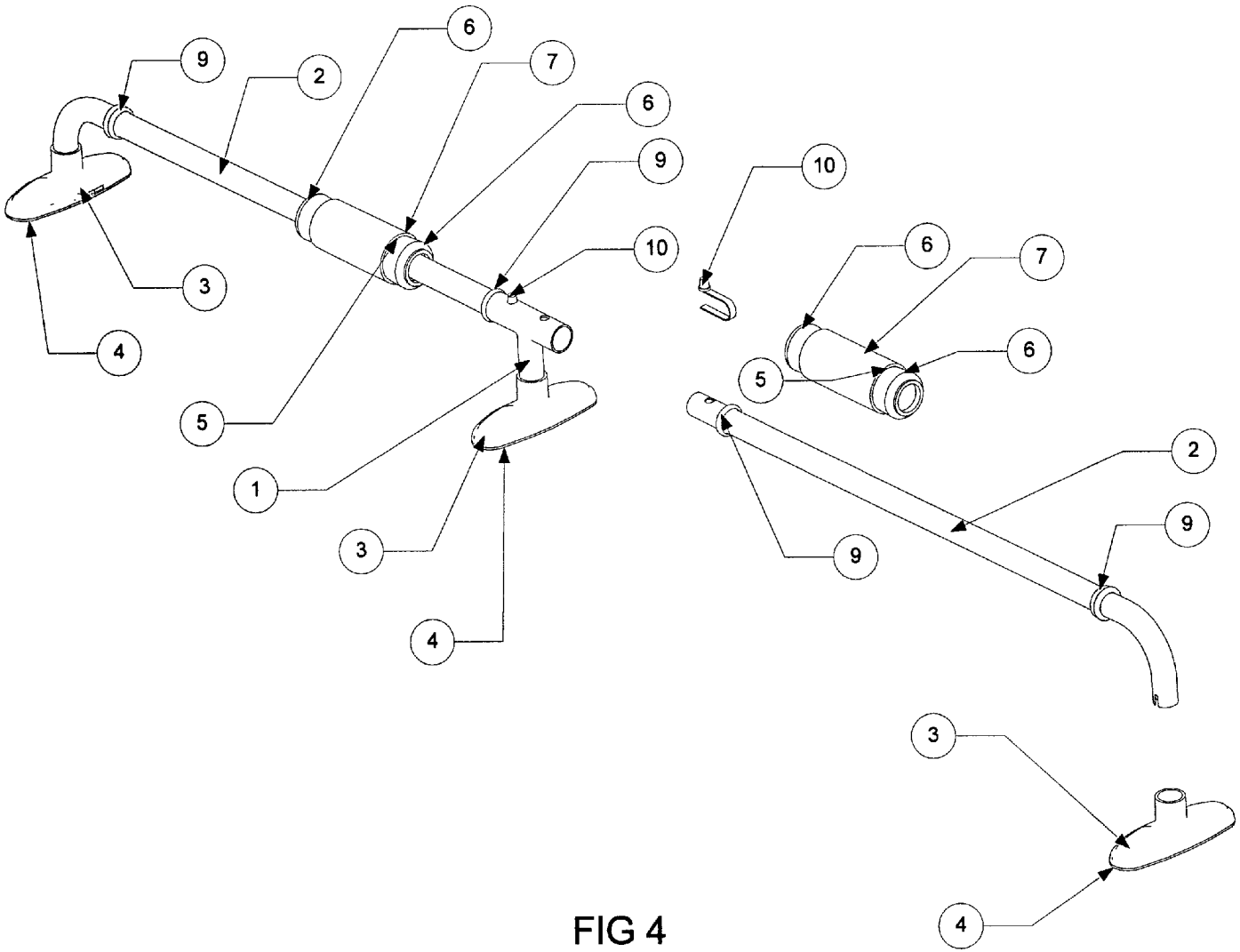
FIG. 4 is a front off center view of the present invention with the right side Slide Tube (2) separated from the T-Tube (1) The right side Locking Pin Assembly (10), Handle (5), Handle Cap (6), Handle Grip (7), Foot (3) and Foot Grip (4) are removed from Slide Tube (2)

The construction details of the invention as shown in (FIGS. 1A and 1B), are that the Slide Tubes (2) and T-Tube (1), will be of such tolerance as to withstand a variety of user weights using a material such as steel. The construction details of the invention as shown in (FIGS. 1A and 1B), are that the Stop Rings (9) will be made of a rigid material such as hard rubber. (FIG. 4) depicts how the right and left side Slide Tubes (2) will connect to the T-Tube (1) via a Locking Pin Assembly (10). In (FIG. 11), the Linear Bearing Assembly (8) will be affixed within the Handle (5). The Linear Bearing Assembly (8) will be relevant to the Slide Tube (2). E.g. a 1" Linear Bearing Assembly (8) would fit over a 1" cylindrical Slide Tube (2). This will allow for the right and left side Handle (5), Handle Cap (6), Handle Grip (7) assembly to move in both a free linear motion and free spin along Slide Tubes (2).

The advantages of the present invention include, without limitation, the ability of the user to perform an upper body exercise that is both safe and efficient by promoting an independent converging motion during the pushup exercise.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. An exercise device, comprising:

a first slide tube defining a first length, the first slide tube adapted for placement on a support surface;

a first handle engaged with the first slide tube, the first handle including a grip adapted for grasping by a user, the first handle adapted to spin about the first slide tube, and slide along the first length of the first slide tube;

a second slide tube defining a second length, the second slide tube adapted for placement on the support surface;

a second handle engaged with the second slide tube, the second handle including a grip adapted for grasping by a user, the second handle adapted to spin about the second slide tube and slide along the second length of the second slide tube; and an inner support connected to the two slide tubes, the inner support adapted to support an inner end of each slide tube above the support surface, wherein the inner support is adapted to disconnect and reconnect by hand from the two slide tubes.

2. The exercise device of claim 1, comprising:

linear bearings disposed between the first slide tube and the first handle, the linear bearings adapted to permit the handle to spin about the slide tube and slide along the length of the slide tube.

3. The exercise device of claim 1, comprising:

two outer supports, each outer support connected to an outer end of a slide tube and adapted to support the outer end of the slide tube to which the outer support is connected above the support surface, each outer support including a foot adapted to stabilize the slide tube to which the outer support is connected in a direction that is perpendicular to the length of the slide tube to which the outer support is connected.

4. The exercise device of claim 1, wherein each slide tube includes an aperture and the inner support includes two apertures, the exercise device comprising:

two quick-release locking pin assemblies, each quick-release locking pin assembly including a pin, wherein each pin extends through an aperture in a slide tube and through an aperture in the inner support, and wherein each of the quick-release assemblies are adapted to releasably attach a slide tube to the inner support.

5. The exercise device of claim 1, wherein the first slide tube length defines a longitudinal axis, and wherein the first handle surrounds the first slide tube and is adapted to spin in a direction that is perpendicular to the longitudinal axis.

6. An exercise device, comprising:

a first slide tube;

a first handle surrounding the outer surface of the first slide tube, the first handle including a grip adapted for grasping by a user; and a first linear bearing assembly disposed between the first handle and the first slide tube, the first linear bearing assembly including a plurality of bearings adapted to decrease friction between the first slide tube and the first handle;

a second slide tube;

a second handle surrounding the outer surface of the second slide tube, the second handle including a grip adapted for grasping by a user;

a second linear bearing assembly disposed between the second handle and the second slide tube, the second linear bearing assembly including at least two rows of bearings adapted to decrease friction between the second slide tube and the second handle; and an inner support connected to a first end of each slide tube and adapted to support the first end of each slide tube above a support surface, the inner support adapted to be disconnected by hand from the first end of each slide tube and reconnected by hand to the first end of each slide tube.

7. The exercise device of claim 6, wherein the plurality of bearings are spaced around the circumference of the first slide tube.

8. The exercise device of claim 6, wherein the first slide tube has a length defining a longitudinal axis, and wherein the plurality of bearings are arranged in at least two rows, and the at least two rows are each oriented parallel to the longitudinal axis.

9. The exercise device of claim 6, wherein the first slide tube defines a length and wherein the first linear bearing assembly is adapted to decrease friction between the first slide tube and the first handle when the first handle spins about the first slide tube and slides along the length of the first slide tube.

10. The exercise device of claim 6, comprising:

two outer supports, each outer support connected to a second end of each slide tube and adapted to support the second end of the slide tube to which the outer support is connected above the support surface, each outer support including a foot adapted to stabilize the slide tube to which the outer support is connected in a direction that is perpendicular to the length of the slide tube to which the outer support is connected.

11. The exercise device of claim 6, wherein the first end of each slide tube includes an aperture and the inner support includes two apertures, the exercise device comprising:

two quick-release locking pin assemblies, each quick-release locking pin assembly including a spring loaded pin extending through an aperture in the inner support and extending through an aperture in the first end of a slide tube, the quick-release assembly being adapted to releasably connect a slide tube to the inner support.

12. An exercise system, comprising:

two elongated slide tubes, each with a length separating first and second ends, the first end of each elongated slide tube including an aperture;

an inner support connectable to the first end of each slide tube and adapted to support the first end of each slide tube above a support surface, the inner support including two apertures;

two handles, each with a grip adapted for grasping by a user;

wherein the exercise system includes a disassembled configuration defined by the two elongated slide tubes and the inner support being disconnected from one another; and wherein the exercise system includes an assembled configuration forming an exercise device with each of the two handles being disposed to slide along the length of a slide tube, and the first end of each elongated slide tube connecting to the inner support with a quick-release locking pin assembly, the pin of each quick-release locking pin assembly being spring loaded and simultaneously extending through one of the apertures in the inner support and through an aperture in the first end of an elongated slide tube.

13. The exercise system of claim 12, comprising:

two outer supports, each outer support connectable to the second end of a slide tube and adapted to support the second end of the slide tube to which each outer support is connected above the support surface and to stabilize the slide tube to which the outer support is connected in a direction perpendicular to the direction between the first and second ends; and wherein the assembled configuration includes the second end of each slide tube being connected to an outer support.

14. The exercise system of claim 13, wherein the elongated slide tubes have a width perpendicular to the length, wherein each of the two outer supports and the inner support includes a foot adapted for placement against the support surface, and wherein the assembled configuration includes each foot being oriented to contact the support surface along a distance that is parallel to and greater than the width of the slide tube.

15. The exercise system of claim 12, wherein the assembled configuration includes each of the two handles being disposed around a slide tube and being disposed to spin about the slide tube around which the handle is disposed.

16. The exercise system of claim 12, comprising:

two linear bearing members, each linear bearing member adapted to be disposed between a handle and a slide tube;

wherein the assembled configuration includes each of the two linear bearing members being disposed between a handle and the slide tube around which the handle is disposed to decrease the friction between the handle and the slide tube around which the handle is disposed.

17. The exercise system of claim 16, wherein each linear bearing member includes at least two rows of bearings, wherein the assembled configuration includes each row of bearings being oriented parallel with the length of elongated the slide tube to which each linear bearing member is attached.

18. The exercise system of claim 12, comprising:

four stop rings, each connectable to an elongated slide tube and adapted to stop a handle from sliding past the stop ring;

wherein the assembled configuration includes one stop ring being connected near the first end of each slide tube and one stop ring being connected near the second end of each slide tube.

* * * * *